US007948180B2

(12) United States Patent
Gotou et al.

(10) Patent No.: US 7,948,180 B2
(45) Date of Patent: May 24, 2011

(54) PLASMA DISPLAY PANEL AND PLASMA DISPLAY PANEL DEVICE WITH REDUCED DRIVING VOLTAGE

(75) Inventors: Masashi Gotou, Osaka (JP); Kyohei Yoshino, Osaka (JP)

(73) Assignee: Panasonic Corporation, Osaka (JP)

( * ) Notice: Subject to any disclaimer, the term of this patent is extended or adjusted under 35 U.S.C. 154(b) by 716 days.

(21) Appl. No.: 11/993,117

(22) PCT Filed: Jun. 16, 2006

(86) PCT No.: PCT/JP2006/312164

§ 371 (c)(1),
(2), (4) Date: Dec. 19, 2007

(87) PCT Pub. No.: WO2007/007514

PCT Pub. Date: Jan. 18, 2007

(65) Prior Publication Data

US 2010/0052509 A1 Mar. 4, 2010

(30) Foreign Application Priority Data

Jul. 8, 2005 (JP) ..... 2005-200040

(51) Int. Cl.
*H01J 17/49* (2006.01)

(52) U.S. Cl. ..... 313/582; 313/587

(58) Field of Classification Search ..... 313/582–587
See application file for complete search history.

(56) References Cited

U.S. PATENT DOCUMENTS

| | | | | |
|---|---|---|---|---|
| 4,703,229 | A * | 10/1987 | Nighan et al. | 315/169.4 |
| 4,780,644 | A * | 10/1988 | Sakai et al. | 313/582 |
| 5,770,921 | A | 6/1998 | Aoki et al. | |
| 6,177,762 | B1 * | 1/2001 | Nakayama | 313/582 |
| 6,628,088 | B2 * | 9/2003 | Kim et al. | 315/169.4 |
| 6,657,396 | B2 | 12/2003 | Nakada et al. | |
| 6,713,958 | B2 | 3/2004 | Oniki | |
| 7,235,928 | B2 | 6/2007 | Shiokawa et al. | |
| 2001/0015621 | A1 * | 8/2001 | Oniki | 313/582 |
| 2002/0070678 | A1 * | 6/2002 | Kim et al. | 315/169.4 |
| 2003/0112206 | A1 * | 6/2003 | Ando et al. | 345/60 |
| 2004/0038615 | A1 * | 2/2004 | Oniki et al. | 445/24 |
| 2004/0095296 | A1 * | 5/2004 | Kojima et al. | 345/60 |
| 2005/0017644 | A1 * | 1/2005 | Ono et al. | 313/633 |
| 2005/0088369 | A1 * | 4/2005 | Yoshioka | 345/60 |
| 2005/0170756 | A1 * | 8/2005 | Yoshikawa et al. | 451/38 |
| 2005/0179383 | A1 * | 8/2005 | Kimura et al. | 313/582 |
| 2005/0179622 | A1 * | 8/2005 | Suzuki | 345/63 |

(Continued)

FOREIGN PATENT DOCUMENTS

JP 63-257163 10/1988

(Continued)

*Primary Examiner* — Nimeshkumar D Patel
*Assistant Examiner* — Jose M Diaz

(57) ABSTRACT

In a panel unit 10, a discharge gas is filled into a discharge space 13. A protective layer 114 is provided in a partial region (a front panel 11 side) facing the inner space 13, and a phosphor layer 124 is provided in a counter region (a back panel 12 side) which holds the discharge space 13. The discharge gas is set at a total pressure of not less than $1.50\times10^4$ [Pa] and not more than $6.66\times10^4$ [Pa], and comprises an Xe gas as a first gas component and an Ar gas as a second gas component and is free from an Ne gas, provided that the Ne gas may be contained in the discharge gas at a partial pressure ratio of not more than 0.5[%] based on the total pressure.

24 Claims, 7 Drawing Sheets

U.S. PATENT DOCUMENTS

| | | | | |
|---|---|---|---|---|
| 2005/0212428 | A1* | 9/2005 | Yoshioka | 313/584 |
| 2005/0280368 | A1* | 12/2005 | Ahn | 313/582 |

FOREIGN PATENT DOCUMENTS

| | | | |
|---|---|---|---|
| JP | 5-101782 | | 4/1993 |
| JP | 10-334811 | | 12/1998 |
| JP | 11-233022 | | 8/1999 |
| JP | 2000156164 | A * | 6/2000 |
| JP | 2001-250484 | | 9/2001 |
| JP | 2002-42663 | | 2/2002 |
| JP | 2002-83543 | | 3/2002 |
| JP | 2002-93327 | | 3/2002 |
| JP | 2002-324487 | | 11/2002 |
| JP | 2002-352728 | | 12/2002 |
| JP | 2003-51259 | | 2/2003 |

* cited by examiner

PLASMA DISPLAY PANEL AND PLASMA DISPLAY PANEL DEVICE WITH REDUCED DRIVING VOLTAGE

TECHNICAL FIELD

The present invention relates to a plasma display panel and a plasma display panel apparatus, in particular to a gas component filled in a discharge space.

BACKGROUND ART

In recent years, a plasma display panel apparatus (hereinafter, referred to as "PDP apparatus") has come to be widely used as a flat display apparatus. Currently, a commonly used PDP apparatus is of an alternate-current type (AC-type), which possesses a high technological potential. Among AC-type PDP apparatuses, an AC-type surface discharge PDP apparatus (hereinafter, simply referred to as "PDP apparatus") is favored for its advantageous lifetime characteristics.

A PDP apparatus is constituted from, such as, a panel unit that displays an image and a display drive unit that drives the panel unit based on an inputted signal. Of these, the panel unit includes a front panel and a back panel that are placed opposing each other via a gap. A plurality of pairs of electrodes each of which is composed of a scan electrode and a sustain electrode are formed in parallel to each other in a stripe pattern on one main surface of a glass substrate of the front panel, and are covered by a dielectric layer and a protective layer.

A data electrode is formed in a stripe pattern on one main surface of a glass substrate of the back panel and covered by a dielectric layer. Barrier ribs in a stripe pattern or grid pattern are provided in a protruding manner on the dielectric layer. In addition, on the back panel, a phosphor layer is formed on an inner wall surface of a concave portion formed by the dielectric layer and the barrier ribs. Each phosphor layer is formed and assigned a color in correspondence with the concave portions partitioned by the barrier ribs.

The front and back panels are arranged such that the protective layer and the phosphor layers oppose each other, and the scan and sustain electrodes and the data electrode intersect three-dimensionally. The gap between the front and back panels is a discharge space filled with a gas mixture such as xenon-neon (Xe—Ne) or xenon-neon-helium (Xe—Ne—He). In the panel configured as above, each area at which the pair of electrodes intersects the data electrode corresponds to a discharge cell.

The display drive unit of the PDP apparatus is connected to each electrode in the panel unit and can apply a voltage pulse to the each electrode independently. The display drive unit drives the panel unit using an in-field time division gray scale display method. This method divides one TV field into a plurality of subfields and performs a control on ON/OFF state of each subfield based on an inputted image signal, the gray-scale display being executed by a total number of "ON" states in one TV field.

One problem area with the PDP apparatus is its extremely low discharge efficiency of a sustain discharge, which is 4[%] to 8[%]. Accordingly, an improvement on the discharge efficiency is sought after from standpoints such as lowering a power consumption. In response to these demands, various approaches have been made, and one such approach is a study on increasing a ratio of Xe in discharge gas (for an example, refer to Patent Document 1).

Patent Document 1: Japanese Laid-Open Patent Application Publication No. 2002-83543

DISCLOSURE OF THE INVENTION

Problems the Invention is going to Solve

However, when raising the ratio of the Xe gas in the discharge gas higher than that of a conventional PDP apparatus, as in the technique disclosed in Patent Document 1, although the discharge efficiency improved, the protective layer exposed to the discharge space got eroded due to sputtering during the sustain discharge. Moreover, the amount of the erosion of the protective layer caused by the sustain discharge became greater as the ratio of the Xe gas (the partial pressure ratio of the Xe gas based on the total pressure) in the discharge gas was made higher from 5[%] to 10[%], and yet higher to 30[%].

The protective layer of the front panel not only protects a surface of the dielectric layer but also performs crucial functions such as a secondary electron emission which pertains to a reduction in a driving voltage, a retention of a wall charge, and so forth. As such, the PDP apparatus in which the ratio of the Xe gas in the discharge gas is simply increased faces disadvantages of decreasing lifespan and reliability, in exchange for an advantage of improving the discharge efficiency.

The present invention was conceived in view of the above problem, and aims to provide a long-lasting and highly reliable plasma display panel and plasma display panel apparatus which exhibit a high discharge efficiency while also suppressing erosion of the protective layer due to sputtering during the sustain discharge.

Means of Solving the Problems

As a result of investigating the relationship between the discharge gas component and the erosion of the protective layer due to sputtering caused by the discharge during the drive, the present inventors found out the following mechanism. That is, in the case where a binary gas mixture of Xe—Ne is used as the discharge gas, when the partial pressure of the Xe gas to the total pressure is increased from 5[%] to 30[%] or higher than that, the erosion of the protective layer during driving of the panel increases as the partial pressure of Xe gas increases. Furthermore, the present inventors focused on the fact that a mass number (atomic mass) of Ne, which is a component of the discharge gas, is in a vicinity of a mass number of a magnesium (Mg) atom and oxygen (O) atom, which are components of the protective layer, and as a result, found out that the Ne gas contained in the discharge gas significantly affects the erosion of the protective layer during driving of the panel.

In view of the above study, the present invention has the following configuration.

The PDP pertaining to the present invention is a panel comprising a hermetically sealed container containing discharge gas in an inner space therein, the hermetically sealed container including a protective layer and a phosphor layer opposing each other across the space, wherein the discharge gas contains: a first gas component composed of a rare gas element which emits light to excite a phosphor in the phosphor layer during a plasma discharge; a second gas component composed of an argon gas; and a neon gas at a partial pressure ratio in a range of 0% to 0.5%, inclusive, to a total pressure of the discharge gas, and wherein the total pressure of the discharge gas in the space is from $1.50\times10^4$ Pa to $6.66\times10^4$ Pa, inclusive.

Here, "(the discharge gas contains:) a neon gas at a partial pressure ratio in a range of 0% to 0.5%, inclusive, to a total pressure of the discharge gas" includes a case in which "Ne gas is not included in the content of the discharge gas".

Also, the PDP apparatus in accordance with the present invention is characterized by including the above PDP in accordance with the present invention as the panel unit, and having the display drive unit connected to the panel unit.

EFFECTS OF THE INVENTION

The discharge gas in the PDP and PDP apparatus in accordance with the present invention contains a first gas component and a second gas component composed of an Ar gas, and a Ne gas is provided to be at a partial pressure of not more than 0.5[%] to the total pressure (inclusive of a case where the discharge gas is free from a Ne gas). With this configuration, the PDP in accordance with the present invention can suppress the erosion of the protective layer due to sputtering caused by a discharge during driving of the PDP, thus gaining an advantage in terms of the panel lifetime and stable quality. In other words, when a Ne gas is contained at a high partial pressure ratio as a component of the discharge gas, as in a conventional PDP, the protective layer becomes eroded when the panel is driven. This is due to the fact that the mass number of an atom of Ne is in the vicinity of the mass number of an atom of Mg, which is included in the protective layer. Meanwhile, the PDP pertaining to the present invention provides that the content ratio of the Ne gas is at a partial pressure ratio of not more than 0.5[%], thus suppressing the erosion of the protective layer during driving of the panel.

Also, the PDP and PDP apparatus in accordance with the present invention provide that the total pressure of the discharge gas is not more than $6.66\times10^4$ [Pa] . Accordingly, unlike when the total pressure of the discharge gas is raised higher than $6.66\times10^4$ [Pa] in order to obtain a high luminance in the panel, a firing voltage does not elevate drastically, which thus does not present a problem when actually realizing the panel. In addition, as the PDP of the present invention provides that the total pressure of the discharge gas is not less than $1.50\times10^4$ [Pa], neither a decrease in the discharge efficiency nor an increase in the firing voltage takes place.

Note that regarding the total pressure of the discharge gas, it is preferable that the upper limit be set to $5.00\times10^4$ [Pa] in order to suppress an increase in the firing voltage.

Also, while the PDP and PDP apparatus of the present invention substantially do not contain a Ne gas in the discharge gas, an Ar gas is contained as the second gas component. Consequently, a high luminous efficiency can be achieved when the panel is driven. This is a result of using Penning effect of Ar atoms and lowering the firing voltage by adding the Ar gas.

Consequently, the PDP pertaining to the present invention and the PDP apparatus including the PDP pertaining to the present invention can achieve a high discharge efficiency while suppressing the erosion of the protective layer caused by sputtering during the sustain discharge, thereby obtaining a long lifespan and high reliability.

Here, a reason should be noted for, as described above, the PDP and PDP apparatus of the present invention to allow a Ne gas to be included in the discharge gas at a partial pressure ratio of 0.5[%] or less. In order to prevent the protective layer from being eroded, it is preferable that the discharge gas be free from the Ne gas. However, when considering an actual manufacturing process, the above range is regarded permissible. That is, in the manufacturing process of a PDP, the discharge space is vacuumed after enclosing the panel and then filled with predetermined gas (a gas mixture including first and second gas components). However, completely exhausting the Ne gas component out of the discharge space requires a more strict process management and a longer exhaustion time. Therefore, on the basis of the knowledge that an existence of the Ne gas at the partial pressure ratio of 0.5[%] or less (for example, in the case where the Ne gas is not completely exhausted from the discharge space during the manufacturing process and remains as an impurity) is not likely to substantially affect the lifespan of the PDP, the permissible range for the Ne gas has been provided as above.

The PDP and PDP apparatus of the present invention can adopt the following as the first gas component composing the discharge gas.

1) the first gas component; xenon (Xe) gas 2) the first gas component; krypton (Kr) gas Note that according to the PDP and PDP apparatus of the present invention, the discharge gas is not limited to a binary gas mixture; a ternary gas mixture or a gas mixture composed of more gas components is also applicable. In these cases also, there is a precondition that the content ratio of the Ne gas of the total pressure as a component of the discharge gas needs to be at the partial pressure ratio of no more than 0.5[%].

When the second gas component is contained in the discharge gas at a partial pressure ratio of 67[%] or less to the total pressure, the PDP and PDP apparatus of the present invention, as has been described, can gain an advantage in terms of discharge efficiency, in addition to the advantage of being able to suppress erosion of the protective layer. In other words, by limiting the partial pressure ratio of the second gas component to not more than 67[%], the discharge efficiency becomes equal to or higher than that of a high-Xe PDP (a PDP having a high content ratio of a Xe gas in the discharge gas) in which Xe(15[%])–Ne(85[%]) discharge gas is filled at a total pressure of $6.66\times10^4$ [Pa]. Consequently, by providing the ratio of the second gas component as above, the PDP and PDP apparatus of the present invention can achieve excellent discharge efficiency while suppressing the erosion of the protective layer during driving of the panel.

Also, when the first gas component of the discharge gas is provided to account for a principal ratio (greatest ratio) in order to improve the luminance, by limiting the partial pressure ratio of the second gas component (Ar gas) to 25[%] or less, the PDP and PDP apparatus of the present invention can exhibit an advantage of being able to keep the firing voltage low as well as the advantages above.

Further, when the partial pressure ratio of the second gas component is 15[%] or less, the PDP and PDP apparatus of the present invention can effectively suppress the erosion of the protective layer during driving of the panel while further improving the discharge efficiency. For example, when the discharge gas is a binary gas mixture including a Xe gas as the first gas component, the second gas component at a partial pressure ratio of 15[%] or less can decrease the erosion of the protective layer in comparison with when using the discharge gas of Xe(15[%])–Ne(85[%]), and the discharge efficiency can be improved due to the high partial pressure of Xe.

Also, in the PDP and PDP apparatus of the present invention, in view of suppressing a prolonged aging time in the manufacturing process, it is preferable that the partial pressure ratio of the second gas component (Ar gas) to the total pressure of the discharge gas be 1[%] or higher, more preferably 3[%] or higher. Specifically, by setting the partial pressure ratio of the Ar gas in the discharge gas to 1[%] or higher, a required aging time can compare favorably with that of when a conventional panel structure is adopted. Especially, by setting the partial pressure ratio of the Ar gas to 3[%] or higher, the aging time can be 10 [hr.] or less, which is preferable from the perspective of manufacturing.

Additionally, in order to reduce a driving voltage (improving discharge efficiency), it is preferable that an oxygen gas be added to the discharge gas of the PDP and PDP apparatus of the present invention. That is, as a result of adding an oxygen gas to the discharge gas, XeO is formed, thereby raising irradiation efficiency of vacuum-ultraviolet rays. Note that a partial pressure ratio of the oxygen gas to be added to the discharge gas is preferably in a range from 0.01[%] to 1[%] in order to obtain a reliable improvement on the discharge efficiency.

Also, in relation to the PDP and PDP apparatus of the present invention, it is preferable that a thickness of the dielectric layer be not more than 20 [μm]. By thinning the thickness of the dielectric layer as above, the firing voltage (sustain voltage) during driving of the panel can be kept low. This is preferable in view of improving the discharge efficiency and suppressing the erosion of the protective layer during driving of the panel.

As has been described above, with the PDP and PDP apparatus of the above present invention, it is possible to raise the ratio of the first gas component, thereby achieving a high luminance. Accordingly, the (display) electrode pairs can be made of a metal without including a component such as an oxide film (ITO (Indium Tin Oxide), ZnO, $SnO_2$ and the like), and thereby the oxide film (transparent electrode film) used in a conventional PDP can be omitted. Consequently, the PDP and PDP apparatus of the present invention can reduce a material cost, a manufacturing cost and the like.

Also, as a specific constituent of the protective layer, the PDP and PDP apparatus of the present invention can adopt magnesium oxide (MgO).

Note that, with the PDP and PDP apparatus of the present invention, the same effects can be obtained when a small amount of a component such as helium (He) is added to the discharge gas.

DESCRIPTION OF REFERENCE NUMERALS

Figure 1:
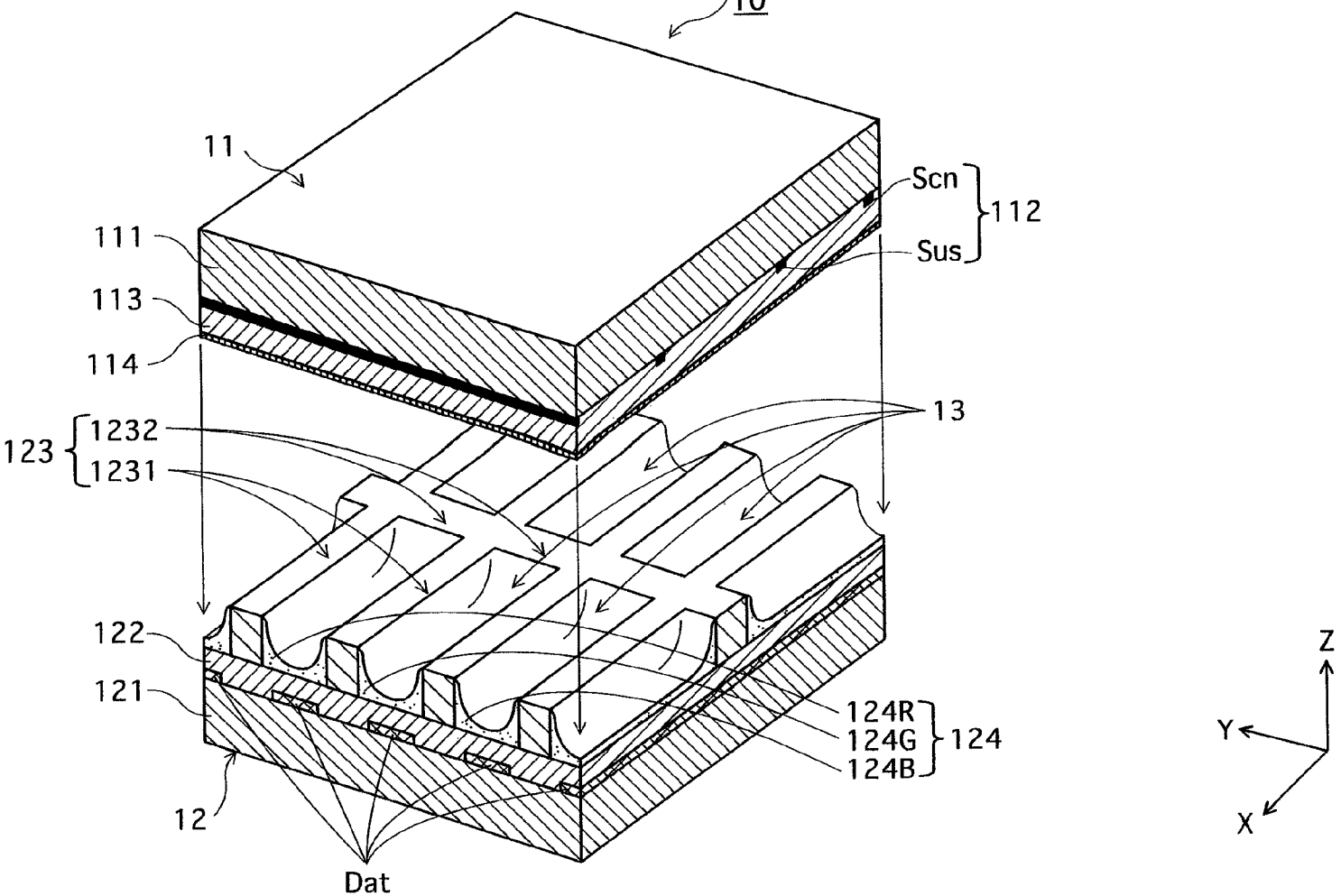
FIG. 1 is a perspective view of a main part of a panel unit 10 of a PDP apparatus 1 pertaining to a first embodiment.

1 PDP apparatus
10 panel unit
11 front panel
12 back panel
13 discharge space
20 display drive unit
21 data driver
22 scan driver
23 sustain driver
24 timing generating unit
25 A/D converter
26 scan number converting unit
27 subfield converting unit
111, 121 substrate
112 display electrode pair
113, 122 dielectric layer
114 protective layer
123 barrier ribs
124 phosphor layer
Scn. scan electrode
Sus. sustain electrode
Dat. data electrode

BEST MODE FOR CARRYING OUT THE INVENTION

The following describes the best mode for carrying out the invention using embodiments. Note that the embodiments used in the following description are only examples, and the present invention is not limited to these except for its characterizing feature.

First Embodiment

1. Structure of Panel Unit 10

Among constituent elements of a PDP apparatus 1 in a first embodiment of the present invention, the following describes a structure of a panel unit 10 using FIG. 1. FIG. 1 is a perspective view of a main part of the panel unit 10.

As shown in FIG. 1, the panel unit 10 includes two panels 11 and 12 arranged opposing each other via a discharge space 13.

1-1. Structure of Front Panel 11

As shown in FIG. 1, the front panel 11, one of the two panels 11 and 12 constituting the panel unit 10, includes a front substrate 111 as a base element. The front panel 11 includes a plurality of display electrode pairs 112, each being made up of a scan electrode Scn and a sustain electrode Sus, formed in parallel to each other on one main surface (facing downward in FIG. 1). And a dielectric layer 113 and a protective layer 114 are formed to cover the display electrode pairs 112, in the stated order.

The front substrate 111, the base element of the front panel 11, is made of, for example, a high-strain-point glass or a soda-lime glass. And each scan electrode Scn and sustain electrode Sus constituting the display electrode pair 112 is made of a metallic material such as aluminum alloy (e.g. Al—Nd), and does not adopt a layered structure of an transparent electrode (e.g. ITO, $SnO_2$, ZnO) and a bus electrode (narrow metal line) employed in a conventional PDP. However, it is possible to adopt the layered structure of ITO, $SnO_2$, ZnO, and the like and a bus electrode for the structure of the scan electrode Scn and the sustain electrode Sus.

The dielectric layer 113 is made of silicon oxide ($SiO_2$), and the thickness is set to approximately 15 [μm]. Additionally, the protective layer 114 is made of magnesium oxide (MgO).

Note that a black stripe can be provided between adjacent display electrode pairs 112 on the surface of the front substrate 111 in order to prevent light from leaking to adjacent discharge cells.

1-2. Structure of Back Panel 12

The back panel 12 includes a plurality of data electrodes Dat on a main surface (facing upward in FIG. 1) of a back substrate 121, the main surface opposing the front panel 11 above. The data electrodes Dat are placed so as to three-dimensionally intersect the display electrode pairs 112 on the front panel 11. A dielectric layer 122 is formed on the main surface of the back substrate 121 with the data electrodes Dat formed thereon, and barrier ribs 123 are formed on the electric layer 122. The barrier ribs 123 are constituted from main barrier ribs 1231 formed vertically between adjacent data electrodes Dat and sub barrier ribs 1232 arranged so as to intersect the main barrier ribs 1231.

A phosphor layer 124 is formed on inner walls of each concave portion formed by the dielectric layer 122 and the barrier ribs 123. The phosphor layer 124 includes a red (R) phosphor layer 124R, a green (G) phosphor layer 124G, and a blue (B) phosphor layer 124B. Each concave portion has one of the three colors of the phosphor layers.

The back substrate 121 of the back panel 12, as with the front substrate 111 of the front panel 11, is formed using a high-strain-point glass or a soda-lime glass. The data electrodes Dat are made of a metal such as aluminum alloy or silver (Ag).

The dielectric layer 122 is made of a silicon oxide or a non-lead low-melting-point glass, as with the dielectric layer 113 of the front panel 11. However, an aluminum oxide ($Al_2O_3$) or titan oxide ($TiO_2$) may also be contained as an element. The barrier ribs 123 are made of a glass material, and the phosphor layer 124 uses the following phosphors for each color or uses a mixture of these for each color.

Red (R) phosphor; (Y,Gd) $BO_3$:Eu $YVO_3$:EU

Green (G) phosphor; $Zn_2SiO_4$:Mn (Y,Gd) $BO_3$: Tb $BaAl_{12}O_{19}$:Mn

Blue (B) phosphor; $BaMgAl_{10}O_{17}$:Eu $CaMgSi_2O_6$:Eu 1-3. Arrangement of Front Panel 11 and Back Panel 12

As shown in FIG. 1, the panel unit 10 is constructed so that the front panel 11 and the back panel 12 oppose each other with the barrier ribs 123 as a gap material therebetween, and the display electrode pairs 112 and the data electrodes Dat are placed substantially orthogonal to each other. The front panel 11 and back panel 12 are sealed at edge portions, forming a hermetically sealed container having the discharge space 13 therein, which is partitioned by the barrier ribs 123.

A binary gas mixture (discharge gas) made up of a xenon (Xe) gas and an argon (Ar) gas is enclosed in the discharge space 13 of the panel unit 10 in the present embodiment. A charging pressure of the discharge gas is set in a range of $1.50\times10^4$ [Pa] to $6.66\times10^4$ [Pa].

In the discharge gas, the Xe gas is included as a first gas component constituted of a rare gas that emits light to excite a phosphor in the phosphor layer during a plasma discharge, and the Ar gas is added to the first gas component as a second gas component. The partial pressure ratio of the Ar gas to the total pressure in the discharge gas is set to 67[%] or less. It is preferable that the partial pressure ratio of the Ar gas be not more than 25[%], and it is even more preferable that the ratio be not more than 15[%]. As to the lower limit of the partial pressure ratio of the Ar gas, 1[%] is preferable to prevent a prolonged aging time during the manufacturing process, and 3[%] is even more preferable. A reason for these will be described later.

2. Structure of PDP Apparatus 1

Figure 2:
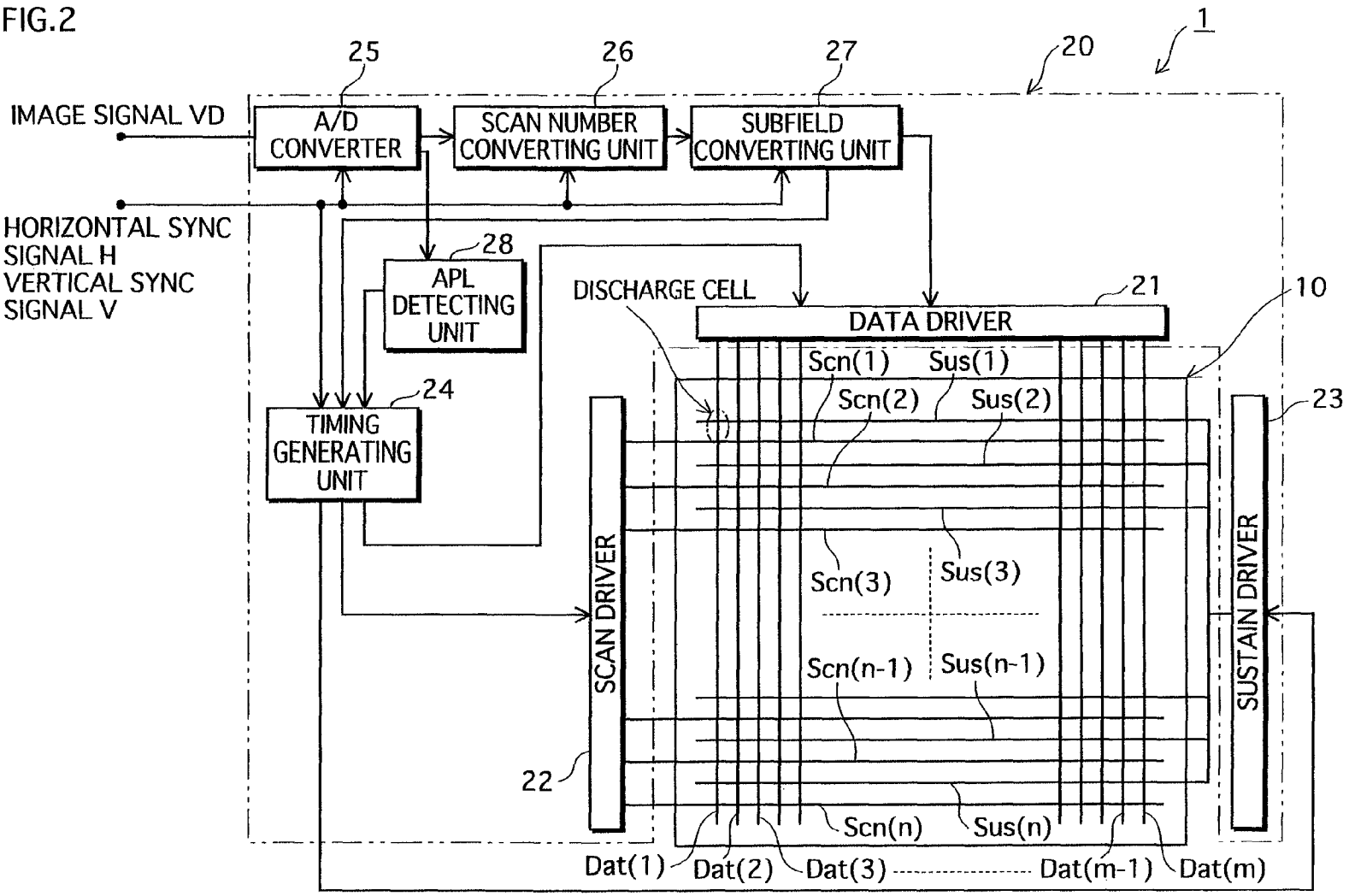
FIG. 2 is a block diagram schematically showing the structure of the PDP apparatus 1.

Here, the overall structure of the PDP apparatus 1 including the above panel unit 10 is described with reference to FIG. 2. FIG. 2 is a block diagram schematically showing the overall structure of the PDP apparatus 1. Note that, in FIG. 2, among the structure of the panel unit 10, only an arrangement of the electrodes Scn, Sus, and Dat is shown schematically.

As shown in FIG. 2, the PDP apparatus 1 includes the panel unit 10 with the structure described above and a display drive unit 20 that applies a voltage pulse having a required waveform to the respective electrodes Scn, Sus, and Dat at a required timing. In the panel unit 10, n scan electrodes Scn and n sustain electrodes Sus are arranged alternately, and m data electrodes Dat are arranged in a column direction. A discharge cell of the panel unit 10 is formed at each intersection of one display electrode pair 112 (Scn(k), Sus(k)) and a data electrode Dat(l), the entire panel unit 10 including (m×n) discharge cells.

The display drive unit 20 includes a data driver 21, a scan driver 22, and a sustain driver 23, which are connected to the data electrodes Dat, the scan electrodes Scn, and the sustain electrodes Sus, respectively. The display drive unit 20 further includes a timing generating unit 24, an A/D converter 25, a scan number converting unit 26, a subfield converting unit 27, and an APL (Average Picture Level) detecting unit 28, which are connected to each of the drivers 21 to 23. Also, although not depicted, a power supply circuit is connected to the display drive unit 20.

An image signal VD inputted to the display drive 20 is inputted to the A/D converter 25, and a horizontal sync signal H and a vertical sync signal V are inputted to the timing generating unit 24, the A/D converter 25, the scan number converting unit 26, and the subfield converting unit 27.

The A/D converter 25 converts the above inputted image signal VD into a digital signal representing image data, and outputs the converted image data to the scan number converting unit 26 and the APL detecting unit 28. After receiving the image data from the A/D converter 25, the APL detecting unit 28 calculates a total of grayscale levels in one screen, based on screen data indicating each grayscale level of each discharge cell in the one screen, and obtains a value by dividing the total value by a total number of discharge cells. After that, the APL detecting unit 28 obtains an average picture level (APL value) by calculating a percentage of the above division result value to a maximum grayscale level (for example, "256"), and outputs the average picture level to the timing generating unit 24.

Here, the higher the APL value is, the whiter the screen is; and the lower the APL value is, the darker the screen is.

Having received the image data from the A/D converter 25, the scan number converting unit 26 converts the image data into image data corresponding to a number of pixels of the panel unit 10, and outputs the converted value to the subfield converting unit 27. The subfield converting unit 27 converts the image data transferred from the scan number converting unit 26 into subfield data and temporarily stores the subfield data in a subfield memory (not depicted). The subfield data is a set of pieces of binary data indicating ON/OFF of a set of subfields with respect to each discharge cell and used for grayscale display in the panel unit 10. The subfield converting unit 27 then outputs the subfield data stored in the subfield memory to the data driver 21 in accordance with a timing signal received from the timing generating unit 24.

The data driver 21 converts the image data for each subfield into a signal corresponding to each of the data electrodes Dat (1) to Dat (m) and applies a voltage pulse to each of the data electrodes Dat (1) to Dat (m). The data driver 21 is provided with a publicly known driver IC and the like.

The timing generating unit 24 generates a timing signal based on the inputted horizontal sync signal H and the vertical sync signal V, and outputs the generated signal to the data driver 21, the scan driver 22, and the sustain driver 23.

The scan driver 22 applies a voltage pulse to the scan electrodes Scn (1) to Scn (n) in accordance with the timing signal received from the timing generating unit 24. The scan driver 22 is provided with a publicly known driver IC and the like, as with the data driver 21.

The sustain driver 23 applies a voltage pulse to the sustain electrodes Sus (1) to Sus (n) in accordance with the timing signal received from the timing generating unit 24. The sustain driver 23 is provided with a publicly known driver IC and the like, as with the data driver 21 and the scan driver 22.

3. Driving PDP Apparatus 1

Figure 3:
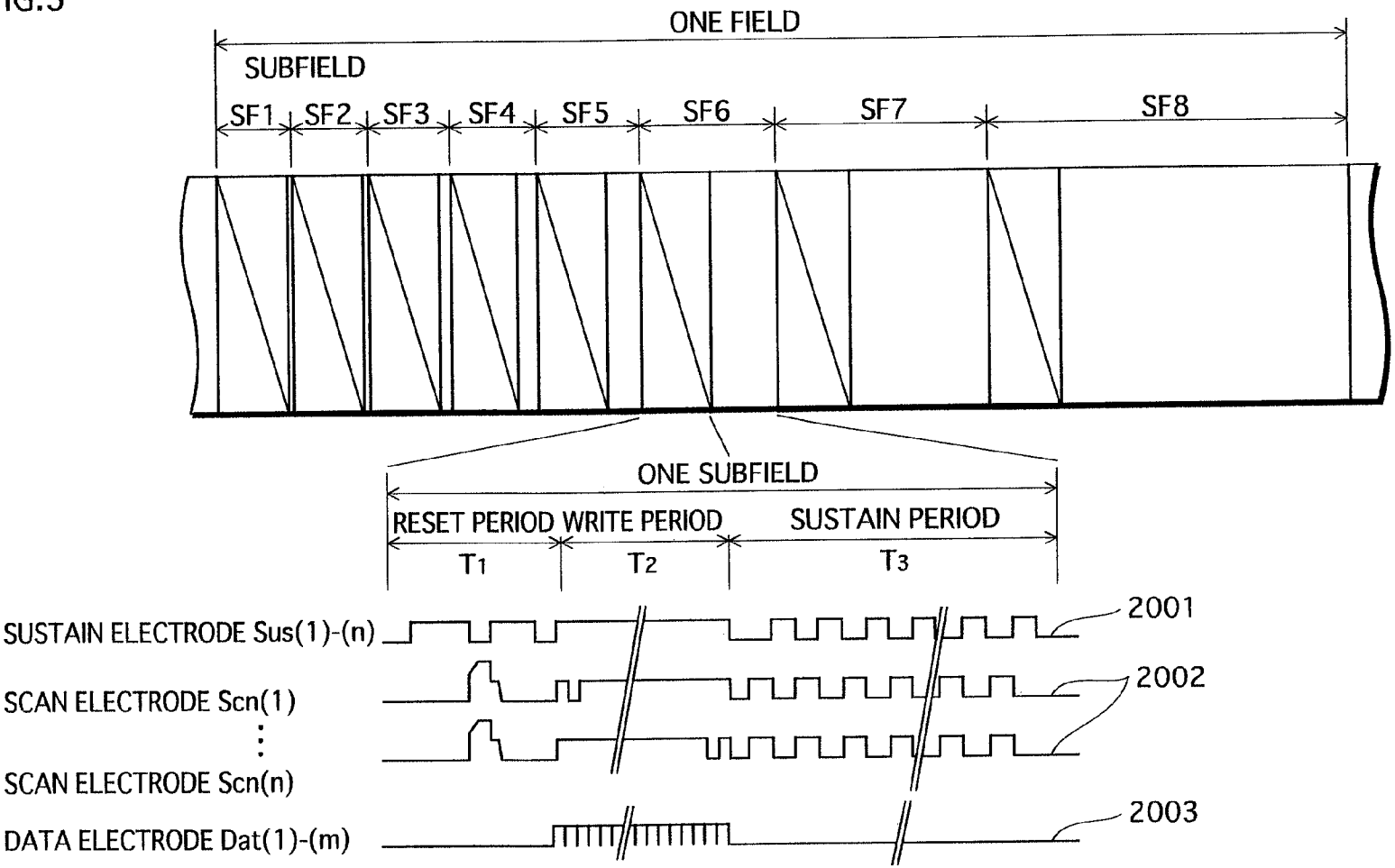
FIG. 3 is a waveform chart showing waveforms of voltage pulses applied respectively to Scn, Sus, and Dat electrodes when the PDP apparatus 1 is driven.

Described below is a drive method of the PDP apparatus 1 with the above structure, with reference to FIG. 3. FIG. 3 is a waveform chart showing the method of driving the PDP apparatus 1 using the in-field time division gray scale display method (the subfield method).

As shown in FIG. 3, as an exemplary case of driving the PDP apparatus 1, one TV field is divided into 8 subfields SF1 to SF8 to display 256 grayscale levels, each of the subfields SF1 to SF8 being constituted from three periods, a reset period $T_1$, a write period $T_2$, and a sustain period $T_3$. A voltage pulse 2001 is applied to the sustain electrodes Sus (1) to Sus (n), a voltage pulse 2002 is applied to the scan electrodes Scn (1) to Scn (n), and a voltage pulse 2003 is applied to the data electrodes Dat (1) to Dat (m), respectively. As described above, the voltage pulses 2001, 2002, and 2003 are applied respectively to each of the electrodes Sus, Scn and Dat in accordance with the timing signal received from the timing generating unit 24.

As shown in the lower part of FIG. 3, in the reset period $T_1$ in each subfield SF, a reset discharge, a weak discharge, is generated in all discharge cells of the panel unit 10, resetting the cells. This eliminates the effect of generating or not generating the discharge in the preceding subfield and absorbs any variance in discharge properties. In the reset period $T_1$, a ramp waveform voltage pulse whose slope (voltage-time) has a slowly rising portion and a slowly falling portion is applied to the scan electrodes Scn (1) to Scn (n). During the rising and falling portions, a discharge current is constantly applied. In the reset period $T_1$, the reset discharge, the weak discharge, is generated once during each of the rising and falling portions of the applied voltage pulse.

In the write period $T_2$ subsequent to the above reset period $T_1$, the Scan electrodes Scn (1) to Scn (n) are scanned line by line in accordance with the subfield data received from the subfield converting unit 27. And a write discharge is generated between the scan electrode Scn and the data electrode Dat in the discharge cell which is to have a sustain discharge in the subfield, thereby accumulating a wall discharge on the surface of the protective layer 114 of the front panel 11.

As shown in FIG. 3, in the sustain period $T_3$, a sustain pulse is applied to all the sustain electrodes Sus (1) to Sus (n) and the scan electrodes Scn (1) to Scn (n) in the panel unit 10 such that polarities of these electrodes change alternately. In the sustain period $T_3$, the waveform of the voltage pulse applied to the sustain electrodes Sus (1) to Sus (n) and the waveform of the voltage pulse applied to the scan electrodes Scn (1) to Scn (n) have the same cycle (for example, $\lambda$=6 [μsec.]), and are out of phase by half a cycle. Note that a height, that is, a voltage, of each sustain pulse is, for instance, set to 180 [V].

In the sustain period $T_3$, by applying a sustain pulse to all of these sustain electrodes Sus (1) to Sus (n) and the scan electrodes Scn (1) to Scn (n), a sustain discharge is generated in the discharge cells in which a wall charge was accumulated in the preceding write period $T_2$. The sustain discharge is generated every time the polarities reverse at the sustain electrodes Sus and the scan electrodes Scn. A number of the sustain discharges in each subfield SF is defined by a luminance weight assigned to the subfield.

As mentioned above, in the discharge cell in which the sustain discharge was generated in the sustain period $T_3$, a resonance line having a wavelength of 147 [nm] is emitted from excited Xe atoms, and a molecular line of 173 [nm] is emitted from excited Xe molecules, in the discharge gas filled in the discharge space 13. These resonance line and molecular line emitted from the excited Xe atoms and molecules are converted into visible light at the phosphor layer 124 in each discharge cell of the back panel 12, and emerge from the front panel 11 side.

This is how the PDP apparatus 1 displays an image based on the input image signal VD and the like.

4. Superior Properties of PDP Apparatus 1

The discharge space 13 of the panel unit 10 in the present embodiment is filled with the binary gas mixture (Xe—Ar). That is, while the discharge gas used in a conventional PDP contains a Ne gas at a high ratio, the discharge gas filled in the panel unit 10 of the present embodiment does not contain a Ne gas as a gas component (at the partial pressure ratio of 0.5[%] or less, even if an Ne gas is contained), and contains the Ar gas as the second gas component after the Xe gas, the first gas component. Therefore, the discharge gas in the panel unit 10 does not contain Ne, which, in terms of the mass number, is in the vicinity of Mg, a constituent element of the protective layer 114 of the front panel 11. Accordingly, even when the partial pressure ratio of the Xe gas, the main gas component, is set high, it is not likely to cause erosion of the protective layer 114 due to sputtering during the sustain discharge.

Note that, as mentioned above, while it is preferable that the discharge gas not contain Ne, which is in the vicinity of Mg in terms of the mass number, the effects described above are not likely to be affected even if the discharge space 13 contains residual Ne at the partial pressure ratio of 0.5[%] or less to the total pressure (for example, a level of impurity which could not be exhausted in the manufacturing process) during the panel manufacturing process.

The protective layer 114 has, other than an original purpose of protecting the surface of the dielectric layer 113, important roles such as the secondary electron emission during driving of the panel, which pertains to reducing the drive voltage and the retention of the wall charge from the write period $T_2$ until the sustain period $T_3$. Consequently, even when the partial pressure ratio of the Xe gas is set high in order to improve the luminance, the PDP apparatus 1 in which erosion of the protective layer 114 is unlikely to occur during driving achieves a long life and high reliability while maintaining high discharge efficiency.

Also, as described above, since the PDP apparatus 1 has the total pressure of the discharge gas set in the range of $1.50\times10^4$ [Pa] to $6.66\times10^4$ [Pa], high discharge efficiency and a low firing voltage can be realized. As to the total pressure of the discharge gas, if set below $1.50\times10^4$ [Pa], in addition to a decrease in the discharge efficiency, an elevation in the firing voltage takes place. On the other hand, if the total pressure is set higher than $6.66\times10^4$ [Pa] the firing voltage becomes too high, thereby becomes less applicable to an actual PDP. Note that in order to achieve the high discharge and the low firing voltage, it is more preferable that the upper limit of the total pressure of the discharge gas be set to $5.00\times10^4$ [Pa].

In addition, in the panel unit 10 of the PDP apparatus 1, each of the scan electrode Scn and the sustain electrode Sus, which compose the display electrode pair 112, is made of an Al alloy material, and does not include a transparent electrode layer such as ITO as a constituent element. Accordingly, when manufacturing the panel unit 10, a material and a forming process in relation to formation of the transparent electrode layer can be omitted, thereby obtaining an advantage in terms of manufacturing cost. Here, it should be noted that the reason for being able to omit the transparent electrode layer, as mentioned above, is that the PDP apparatus 1 of the present embodiment can achieve an excellent luminance.

In the present embodiment, the respective electrodes Scn and Sus of the display electrode pair 112 are constructed as a metal line. However, a plurality of metal lines arranged and connected in parallel can be used to form the respective electrodes Scn and Sus. Also, other than the Al alloy material, silver (Ag), copper (Cu) or the like can be used as a construction material of these electrodes Scn and Sus.

Additionally, in the panel unit 10 of the PDP apparatus 1, the dielectric layer 113 is made of $SiO_2$ with the thickness of approximately 15 [μm]. Accordingly, the PDP apparatus 1 can further reduce the firing voltage. That is, as $SiO_2$ has a lower dielectric constant in comparison to a low-melting point glass used to form the dielectric layer of a conventional PDP, it is possible to thin down to a thickness of 20 [μm] or less. Formation of a thin dielectric layer 113 makes it possible for the voltage applied to the display electrode pair 112 in the sustain period $T_3$ to be effectively applied to the discharge space 13, with it being possible to reduce the firing voltage.

As described above, the PDP apparatus 1 pertaining to the present embodiment suppresses erosion of the protective layer due to sputtering during the sustain discharge, while also obtaining high discharge efficiency, and thereby exhibits a long life and high reliability.

5. Ratio of Respective Components of Discharge Gas

The following describes confirmatory experiments conducted to specify a component ratio of the discharge gas. In the confirmatory experiments described below, an apparatus having the same structure as the above PDP apparatus 1 is used.

5-1. Dependence of Discharge Efficiency on Ar Gas Addition Ratio

First, the relationship between discharge efficiency and an addition ratio (partial pressure ratio) of an Ar gas in the discharge gas of a PDP apparatus was confirmed. In the present confirmatory experiment, experimental conditions regarding the discharge gas were specified as follows.

Discharge gas: a Xe—Ar binary gas mixture

Partial pressure ratio of Xe: constant at $2.2\times10^4$ [Pa]

Addition ratio of Ar gas: the partial pressure ratio was changed from 0[%] to 67[%] relative to the total pressure of the discharge gas.

It should be noted that, as a comparative example, another set of conditions were prepared. Specifically, a Xe—Ne binary gas mixture was used as the discharge gas, the partial pressure of the Xe gas was $2.2\times10^4$ [Pa] as is the above case, and the partial pressure ratio of the Ne gas to the total pressure was 5[%].

Discharge efficiency of each sample above is measured, and a relative value was calculated against a conventional PDP apparatus (a Xe—Ne binary gas mixture for the discharge gas, the partial pressure ratio of Xe at 15[%] and Ne at 85[%], and the total pressure at $6.66\times10^4$ [Pa]). The calculated results are shown in FIG. 4.

Figure 4:
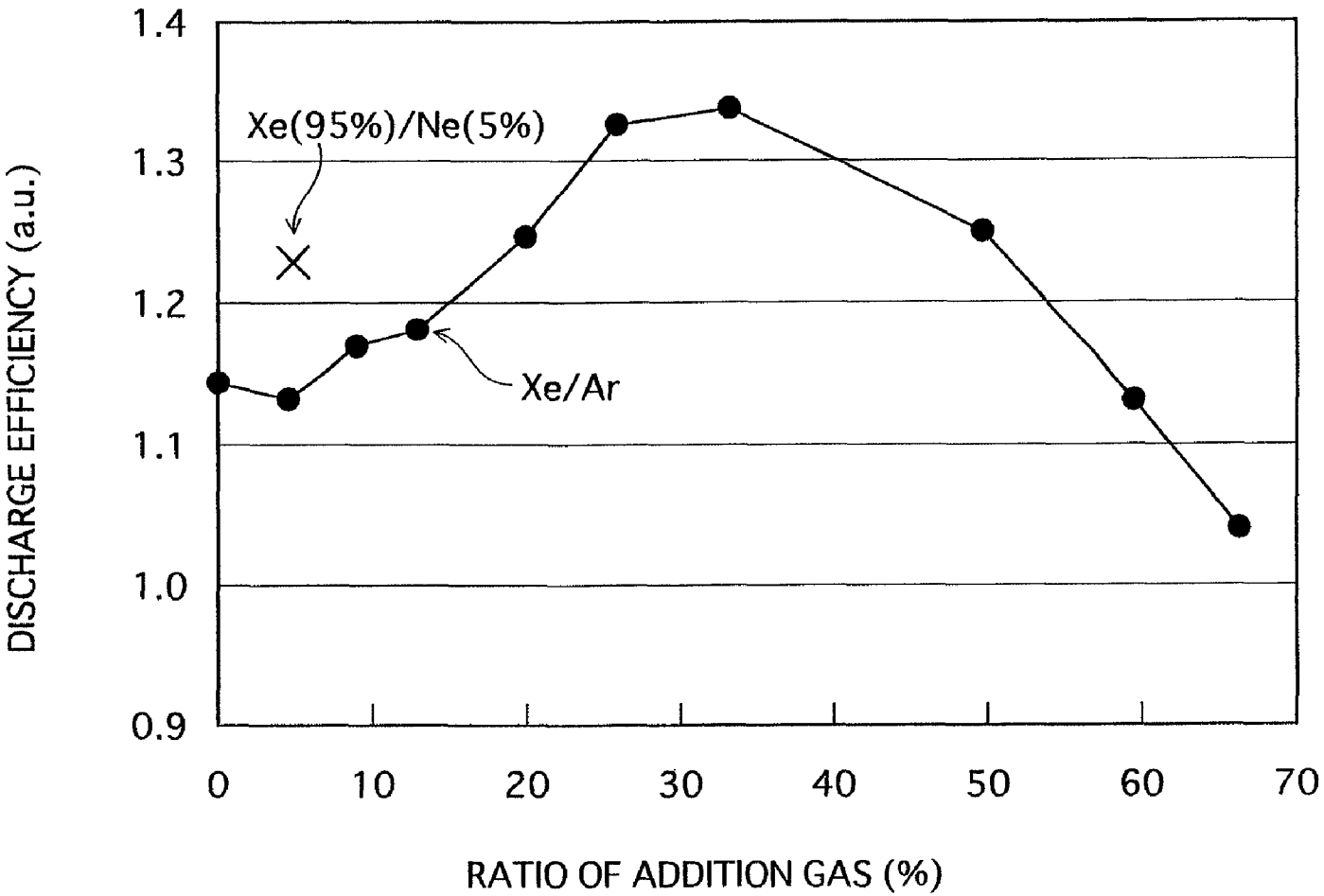
FIG. 4 is a characteristic chart showing a relationship between discharge efficiency and a partial pressure ratio of an Ar gas to a total pressure of discharge gas when a binary gas mixture of Xe—Ar is adopted as the discharge gas.

As shown in FIG. 4, in the PDP apparatus using the Xe—Ar binary gas mixture as the discharge gas, when the addition ratio of the Ar gas is in a range of 0[%] to approximately 33[%], the discharge efficiency increases as the addition ratio of the Ar gas increases. However, the discharge efficiency starts decreasing after the addition ratio of the Ar gas exceeds approximately 33[%]. Also, the comparative example shows higher efficiency in comparison to the sample containing an Ar gas at the same ratio. This is considered due to the decrease in the firing voltage, an advantage made possible by containing a Ne gas as a component element in the discharge gas.

However, as the present inventors identified, when the discharge gas is a Xe—Ne binary gas mixture, and the partial pressure ratio of the Ne gas to the total pressure is 8[%] or higher, the erosion of the protective layer during driving of the panel becomes significant, thus not actually applicable.

As shown in FIG. 4, when the discharge gas is a Xe—Ar binary gas mixture, and the addition ratio of the Ar gas is 67[%] or less, higher discharge efficiency rate is achieved in comparison to the conventional PDP apparatus, a comparative benchmark.

5-2. Dependence of Firing Voltage on Ar Gas Addition Ratio

Next, a minimum voltage required for generating a discharge, that is, a firing voltage, was measured for each of the samples which are the same as above. The results are shown in FIG. 5.

Figure 5:
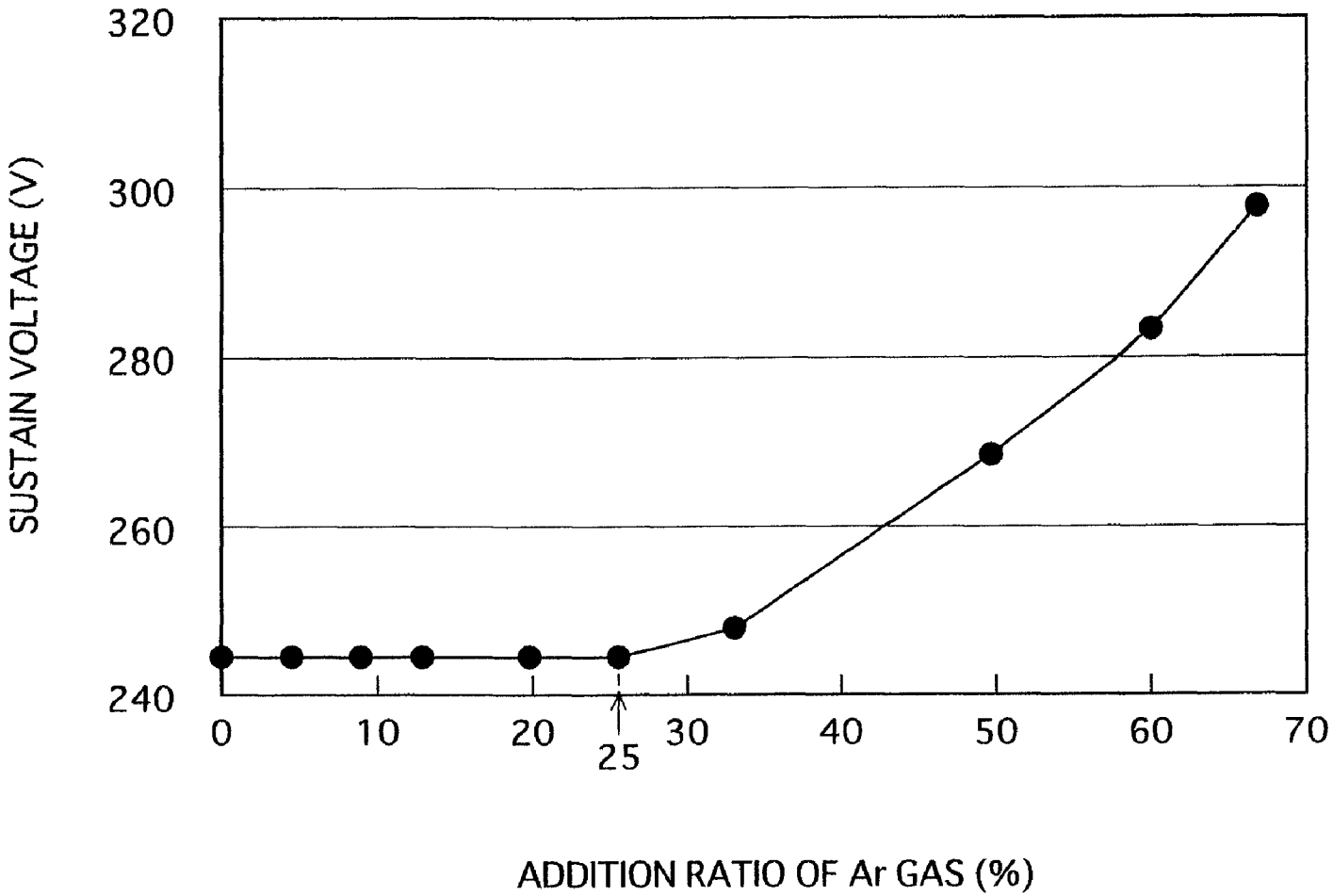
FIG. 5 is a characteristic chart showing a relationship between a sustain voltage required during a sustain period and the partial pressure ratio of the Ar gas to the total pressure of the discharge gas when the binary gas mixture of Xe—Ar is adopted as the discharge gas.

As shown in FIG. 5, the firing voltage (in FIG. 5, referred to as "sustain voltage") is stable at approximately 245 [V] when the addition ratio of the Ar gas is in a range from 0[%] to 25[%], and the firing voltage starts rising after the addition ratio of the Ar gas exceeds 25[%]. For example, when the addition ratio of the Ar gas is 67[%], the firing voltage is approximately 298 [V], approximately 53 [V] higher than when the addition ratio of the Ar gas is 25[%] or less.

From these results, the following can be considered. When the ratio of the Ar gas is no more than 25[%], a balance is maintained between a decrease in voltage due to adding an Ar gas and an increase in voltage due to an increase in the total pressure of the discharge gas. However, after the ratio of the Ar gas exceeds 25[%], the increase in voltage due to the increase of the total pressure of the discharge gas has more effect. Consequently, in order to provide a low firing voltage, it is preferable that the addition ratio of the Ar gas in the discharge gas be not more than 25[%].

5-3. Dependence of Sputtering Rate on Xe Gas Ratio

Next, the relationship between a Xe gas ratio in the discharge gas and a sputtering rate of the protective layer 114 due to a discharge during driving of the panel was confirmed. Samples were prepared in accordance with the following conditions, and the sputtering rate was calculated for each sample.

Discharge gas: a Xe—Ar binary gas mixture

Total pressure of discharge gas: $6.0\times10^4$ [Pa]

Partial pressure ratio of Xe: the partial pressure ratio was changed from 5[%] to 99[%] relative to the total pressure of the discharge gas.

It should be noted that, as a comparative example, another set of samples were prepared, and the sputtering rate was calculated for these samples as well. Specifically, a Xe—Ne binary gas mixture was used as the discharge gas, and the ratio of the Xe gas was changed from 5[%] to 99[%].

The calculation of the sputtering rate was performed in consideration of a sputtering probability of each ion, an ion density, and an ion energy distribution.

Figure 6:
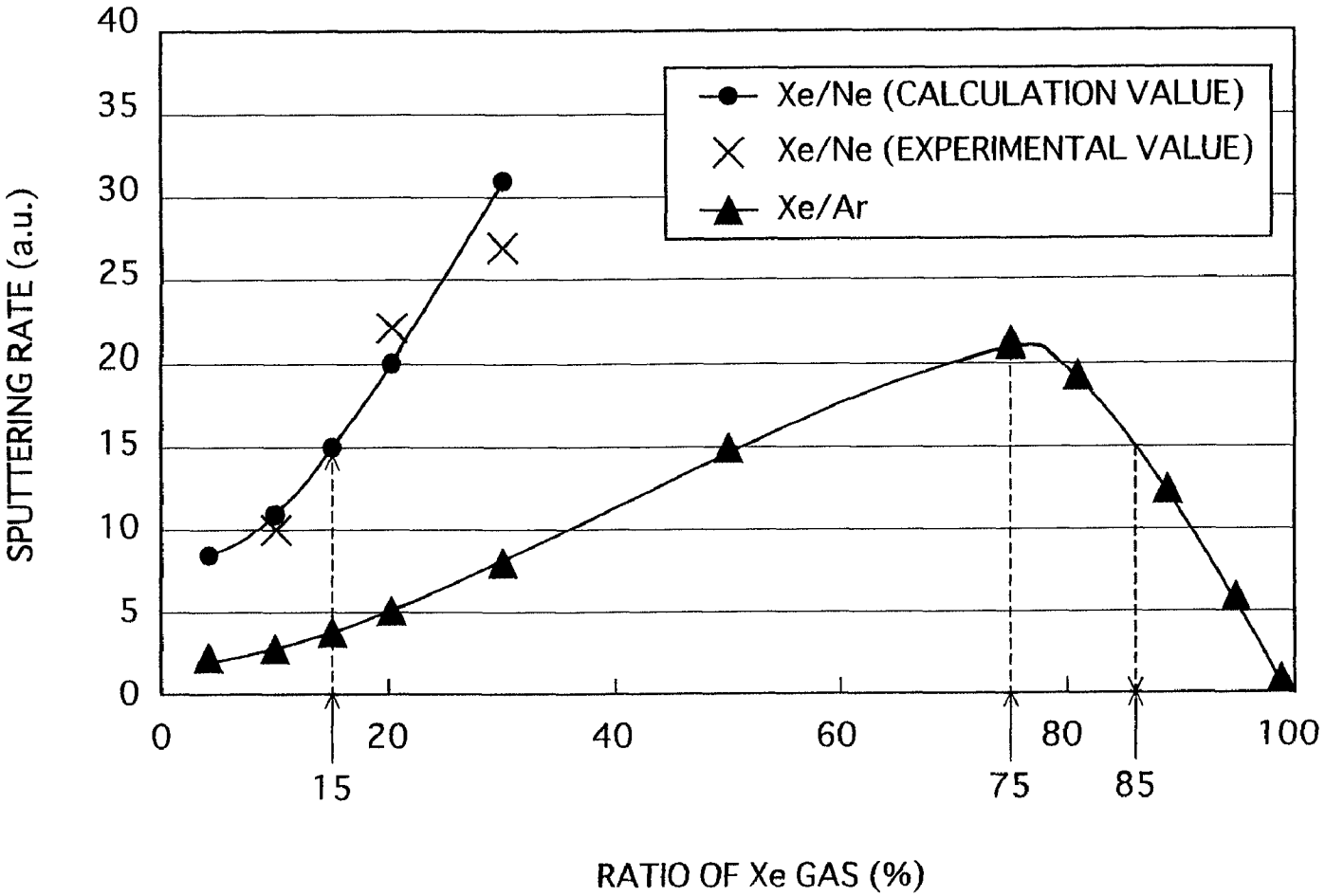
FIG. 6 is a characteristic chart showing a relationship between a sputtering rate and a partial pressure ratio of an Xe gas to the total pressure of the discharge gas when the binary gas mixture of Xe—Ar is adopted as the discharge gas.

As shown in FIG. 6, it was observed that when using the sample pertaining to the comparative example in which Xe—Ne is filled as the discharge gas, as the ratio of the Xe gas increases, the sputtering rate also increases. For example, when the ratio of the Xe gas is 5[%], the sputtering rate is approximately "8"; when the ratio of the Xe gas is 15[%], the sputtering rate is "15"; and when the ratio of the Xe gas is 30[%], the sputtering rate is "31". Note that FIG. 6 also shows the sputtering rate calculated using a sample in accordance with the comparative example. As shown in FIG. 6, an experimental value and a calculation value are consistent with each other.

As shown in FIG. 6, when the Xe—Ar binary gas mixture is used as the discharge gas, the sputtering rate increases as the ratio of the Xe gas increases as long as the ratio of the Xe gas is in a range of 5[%] to 75[%]. When using the Xe—Ar gas mixture, however, an increase speed of the sputtering rate is gradual in comparison to the comparative example using the Xe—Ne gas mixture, and the sputtering rate marks "21", the highest value, when the ratio of the Xe gas is 75[%]. The highest value "21" obtained when using the Xe—Ar gas mixture is approximately equal to the sputtering rate obtained when the ratio of the Xe gas is 20[%] in the comparative sample.

Also, as shown in FIG. 6, when the Xe—Ar gas mixture is used, the sputtering rate decreases as the ratio of the Xe gas increases, given that the ratio of the Xe gas is in a range of 75[%] to 99[%]. This is contrary to when the ratio of the Xe gas is below 75[%]. For example, when the ratio of the Xe gas is 99[%], the sputtering rate is approximately "0", the erosion of the protective layer being insignificant even during a discharge when the panel is driven.

Further, as shown in FIG. 6, it is clear that, when using a Xe—Ar binary mixture as the discharge gas, the ratio of the Xe gas needs to be 85[%] or higher in order to ensure the sputtering rate equal to or less than the conventional PDP apparatus (a Xe—Ne binary gas mixture as the discharge gas, the partial pressure ratio of the Xe at 15[%] and the Ne at 85[%], and the total pressure at $6.66\times10^4$ [Pa]). In other words, when using the Xe—Ar binary gas mixture as the discharge gas, the addition ratio of the Ar gas being 15[%] or less can ensure the sputtering rate equal to or lower than the conventional PDP apparatus.

From the above results, it is clear that, by using a Xe—Ar binary gas mixture without Ne, instead of using a conventional Xe—Ne binary gas mixture, as the discharge gas, even when the ratio of the Xe gas is set high, the sputtering rate can be kept low.

5-4. Dependence of Aging Time (when Manufacturing) on Ar Gas Ratio

Figure 7:
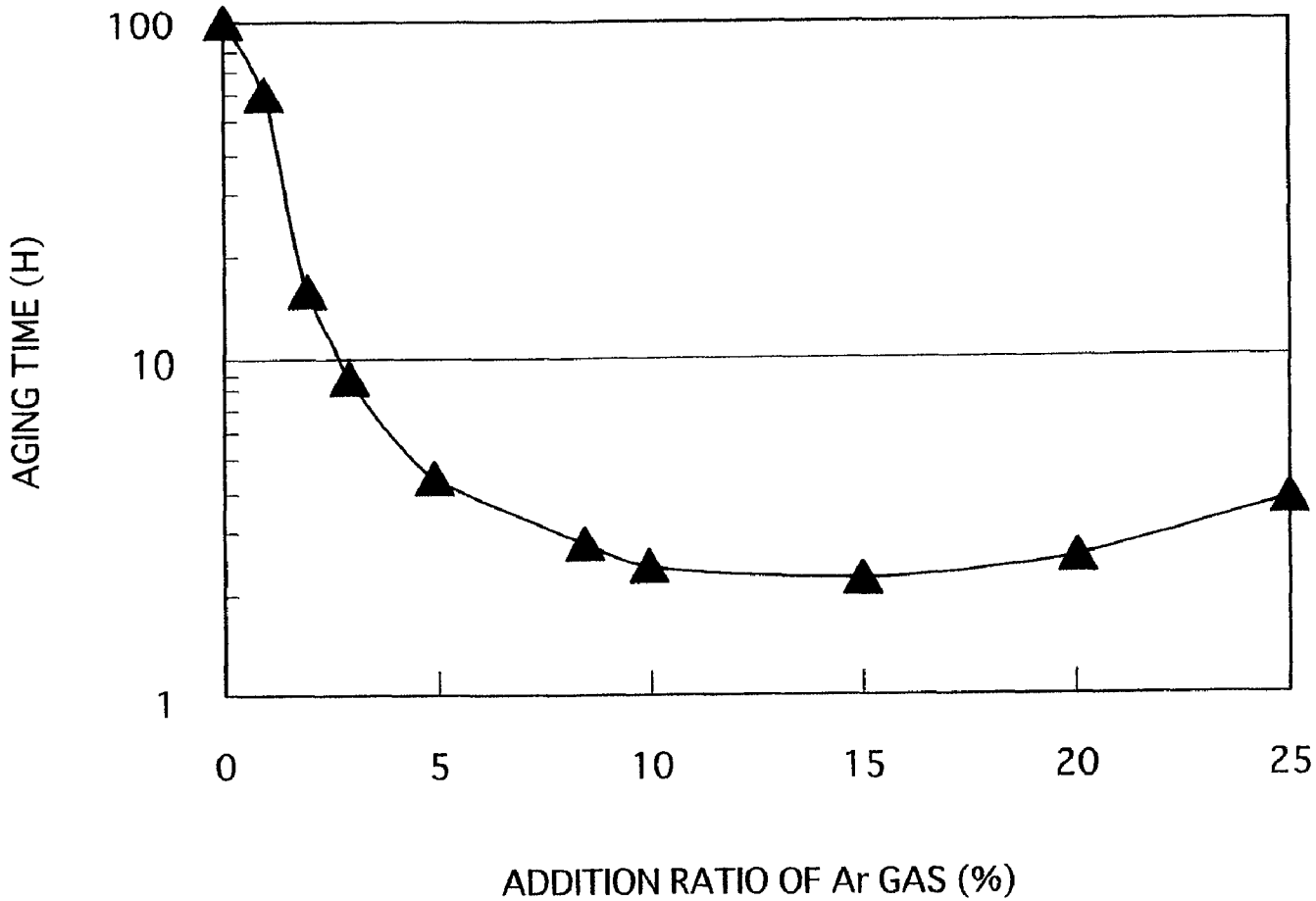
FIG. 7 is a characteristic chart showing a relationship between an aging time during a manufacturing process and the partial pressure ratio of the Ar gas to the total pressure of the discharge gas when the binary gas mixture of Xe—Ar is adopted as the discharge gas.

The following describes a ratio of an Ar gas in the discharge gas and an aging time in the manufacturing process, with reference to FIG. 7. In order to obtain a characteristic chart of FIG. 7, aging times were calculated with conditions that i) a 100[%] Xe gas or a Xe—Ar binary gas mixture was used as the discharge gas, ii) a partial pressure ratio of the Xe gas in the gas mixture was constant at 30 [kPa], and iii) a ratio of the Ar gas was changed. Note that the aging time is a time required for a process in which, after an apparatus is assembled, a voltage is applied to each electrode Scn, Sus, and Dat until an initial variance of the firing voltage converges to a stable state, for example, in a range of 5 [V] above or below 250 [V].

As shown in FIG. 7, when the ratio of the Ar gas in the discharge gas is 1[%] or more, the aging time can be shortened compared to the PDP apparatus with the discharge gas composed of 100[%] Xe. Also, when the addition ratio of the Ar gas is in an approximate range of 1[%] to 10[%], the aging time gets shortened rapidly as the addition ratio of the Ar gas increases. Meanwhile, once the ratio exceeds 10[%], the aging time stops showing a significant change.

When using the Xe—Ar binary gas mixture, with the addition ratio of the Ar gas at 3[%] or more, the aging time becomes shorter than 10 [hr.], which bears comparison with the aging time of the conventional PDP apparatus.

It should be noted here that while the present confirmation was conducted on the relationship with the aging time using the Xe—Ar gas mixture, similar results can be obtained when using a krypton (Kr) gas instead of a Xe gas.

Consequently, as can be seen in FIG. 7, it is preferable that the addition ratio of the Ar gas in the discharge gas be 1[%] or more in view of the aging time, and it is more preferable that the ratio be 3[%] or more as the aging time can be shortened to less than 10 [hr.]

5-5. Considerations

From the results of the confirmatory experiments shown in FIG. 4 to FIG. 7, the following can be concluded. When using a Xe—Ar binary gas mixture as the discharge gas, i) the addition ratio of the Ar gas of 67[%] or less ensures a low sputtering rate while also achieving high discharge efficiency, ii) the addition ratio of the Ar gas of 25[%] or less further improves the discharge efficiency, and iii) the addition ratio of the Ar gas of 15[%] or less can provide a long life that equals or surpasses the conventional PDP apparatus having its discharge gas made up of Xe(15[%])–Ne(85[%]).

As mentioned above, when using a Xe—Ar binary gas mixture as the discharge gas, the erosion of the protective layer 114 during driving of the panel can be reduced by excluding Ne from the constituent element. This is considered due to the following reasons.

As has been described, MgO is used for the protective layer 114 in order to protect the dielectric layer 113 and secure a secondary electron emission coefficient. Meanwhile, the discharge gas of the conventional PDP apparatus contains Ne, which is in the vicinity of a Mg atom and an O atom, constituent elements of the protective layer 114, in terms of the mass number. Consequently, when the panel is driven, due to Ne atoms colliding with the protective layer, the energy of the Ne atoms are given to Mg and O resonantly, and accordingly, the protective layer is sputtered at a high probability in the conventional PDP apparatuses.

On the other hand, the PDP apparatus pertaining to the present embodiment employs a Xe—Ar binary gas mixture as the discharge gas and does not include a Ne gas as a component (inclusion at the partial pressure ratio of 0.5[%] or less to the total pressure is allowed). Consequently, the above sputtering probability can be reduced. As a result, in the PDP apparatus 1 of the present embodiment, the erosion of the protective layer 114 due to sputtering by a discharge can be suppressed.

Also, from the perspective of the aging time during the manufacturing process, the addition ratio of the Ar gas of 1[%] or more is preferable, and 3[%] or more is more preferable.

Here, in the present embodiment, a Xe—Ar binary gas mixture is used as the discharge gas, but alternatively, a Kr—Ar binary gas mixture, a Xe—Ar—Kr ternary gas mixture and the like can provide the same effects. Also, the same effects can still be obtained with an additional few[%] He gas.

Furthermore, when the total pressure of the discharge gas is in a range of $1.50\times10^4$ [Pa] to $6.66\times10^4$ [Pa], the same effects as those confirmed with reference to FIG. 4 to FIG. 7 can be obtained.

Second Embodiment

The following describes a PDP apparatus pertaining to a second embodiment. The PDP apparatus of the present embodiment differs from the PDP apparatus 1 of the first embodiment in the composition and total pressure of the discharge gas, the material and thickness of the dielectric layer of the front panel, and the constituent materials of the respective electrodes of the display electrode pairs. Other parts are the same as in the first embodiment, therefore their descriptions are omitted here.

In the PDP apparatus of the present embodiment, a Kr—Ar binary gas mixture is filled into the discharge space of the panel unit. Among the gas components, the Kr gas, due to a plasma discharge, emits light (vacuum ultraviolet rays) which excites a phosphor constituting a phosphor layer, and the partial pressure of the Kr gas is set to $3\times10^4$ [Pa]. The Ar gas, another constituting component of the discharge gas, is added, as in the first embodiment, to improve discharge efficiency by decreasing the sustain voltage during driving of the panel. The partial pressure of the Ar gas is set to $7.5\times10^3$ [Pa].

In the PDP apparatus of the present embodiment, the total pressure of the discharge gas is $3.75\times10^4$ [Pa], and the partial pressure ratio of the Ar gas to the total pressure is $7.5\times10^3/3.75\times10^4=0.20$, that is, 20[%]. Also, the dielectric layer of the panel unit is formed using a non-lead low-melting-point glass material, and the thickness is approximately 19 [μm]. The respective scan and sustain electrodes composing the display electrode pair are all made of silver (Ag), and do not include a transparent electrode layer such as ITO, as in the first embodiment.

While not illustrated here, confirmatory experiments were conducted on discharge efficiency and a sputtering rate of the protective layer of the PDP apparatus of the present embodiment, as in the first embodiment. According to the results of these confirmatory experiments, the PDP apparatus of the present embodiment may improve the discharge efficiency by approximately 6[%] in comparison to when adopting a 100 [%] Kr gas as the discharge gas.

Also, with the PDP apparatus of the present embodiment, as is the case using a Xe—Ar gas mixture as the discharge gas as shown in FIG. 5, when the addition ratio of the Ar gas is in a range of 0[%] to 25[%], the firing voltage is stable, being substantially constant; when the addition ratio of the Ar gas exceeds 25[%], the firing voltage tends to increase. This aspect is the same as in the first embodiment as well.

The PDP apparatus of the present embodiment also does not include a Ne gas (inclusion at a partial pressure ratio of 0.5[%] or less to the total pressure is allowed) in the discharge gas but includes an Ar gas instead. Accordingly, the sputtering rate of the protective layer in the course of a discharge during driving of the panel is suppressed to a low level. As to the partial pressure ratio of the Ar gas to the total pressure in the discharge gas, as is the case with the above embodiment where a Xe—Ar binary gas mixture is adopted as the discharge gas, i) a preferable range is 67[%] or less, ii) a more preferable range is 25[%] or less, and iii) an even more preferable range is 15[%] or less.

Here, by way of comparison, use of a Kr—Ne binary gas mixture as the discharge gas is examined. The partial pressure ratio of the Ne gas to the total pressure is set to 20[%]. This PDP apparatus has an advantage in terms of improving discharge efficiency when compared to using a 100[%] Kr gas as the discharge gas, but this PDP also has a disadvantage of having an extremely high sputtering rate of the protective layer during the discharge when the panel is driven. Accordingly, it is difficult to realize such a PDP apparatus.

As described above, the PDP apparatus of the present embodiment does not include a Ne gas as a component of the discharge gas but includes an Ar element, the mass number of which is greater than that of Mg or O both constituting the protective layer. Consequently, the PDP suppresses the erosion of the protective layer due to sputtering during a sustain discharge, and exhibits a long life and high reliability while also achieving high discharge efficiency.

Note that different variations can be adopted for the PDP apparatus of the present embodiment, as is the case with the first embodiment above.

Also, regarding the configuration of the dielectric layer and display electrode pair of the present embodiment, a reason for the adoption and achieved effects are the same as those in the first embodiment.

Third Embodiment

Next, a PDP apparatus pertaining to a third embodiment will be described. The PDP apparatus of the present embodiment differs from the PDP apparatus 1 of the first embodiment in the composition and total pressure of the discharge gas, and the thickness of the dielectric layer of the front panel. Since other parts are the same as those in the first embodiment above, their descriptions are omitted here.

In the PDP apparatus pertaining to the present embodiment, the discharge space in the panel unit is filled with a Xe—Ar—O ternary gas mixture. That is, in the PDP apparatus of the present embodiment, a Xe gas is contained as the first gas component which consists of a rare gas and emits light to excite a phosphor in a phosphor layer during a plasma discharge; in addition to this, an Ar gas is contained as the second gas component; further, an oxygen (O) gas is added to these as the third gas component. The total pressure of the discharge gas is set to $3.5\times10^4$ [Pa].

The partial pressure ratio of the Ar gas to the total pressure of the discharge gas is set to 24.5[%], and the partial pressure ratio of the O gas to the total pressure is set to 0.5[%]. XeO excimer exists in the discharge gas to which a small amount of O gas is added, and an ionization energy of the XeO is smaller than Xe itself, thus producing a friendly effect to generation of an initial electron. Consequently, the PDP apparatus of the present embodiment can reduce the firing voltage even further in comparison to the PDP apparatus 1 of the first embodiment.

Additionally, while the addition ratio of the O gas, the third gas component, is set to 0.5[%], it is preferable that this ratio be in a range of 0.01[%] to 1[%]. This is because the addition ratio of the O gas in the discharge gas can, even at a minute amount of 0.01[%], produce effects in reducing the firing voltage, while the ratio higher than 1[%] causes the firing voltage to increase.

The dielectric layer is made of silicon oxide ($SiO_2$), as in the case with the PDP apparatus of the first embodiment, and formed to a thickness of approximately 16 [μm].

With the above-configured PDP apparatus of the present embodiment, as is the case with the PDP apparatus 1 of the first embodiment, erosion of the protective layer caused by sputtering during a sustain discharge can be suppressed, thereby achieving a long life and high reliability, and the firing voltage can be further reduced in comparison to the PDP apparatus 1.

Note that different variations can be applied to the PDP apparatus of the present embodiment, as with the first and second embodiments.

[Additional Particulars]

The first to third embodiments above only provide examples to describe the configuration of the PDP and PDP apparatus pertaining to the present invention and the effects obtained therewith. Accordingly, the present invention is not restricted to these except for a characterizing aspect. For example, the first embodiment uses a Xe—Ar binary gas mixture as the discharge gas, the second embodiment uses a Kr—Ar binary gas mixture, and the third embodiment uses a Xe—Ar—O ternary gas mixture. However, combinations below can be adopted.

Xe—Ar (1)

Xe—Ar—Kr (2)

Xe—Ar—O (3)

Xe—Ar—Kr—O (4)

Kr—Ar (5)

Kr—Ar—O (6)

Xe—Kr (7)

Xe—Kr—O (8)

Additionally, a small amount (for example, a few [%]) of He gas can be added to each of the above combinations. Moreover, it is also possible to add a small amount of a component, as long as the component is not Ne gas.

Also, although phosphor materials constituting each of the phosphor layers 124R, 124G, and 124B are provided as examples in the first embodiment and the like above, other than those, each of the following phosphor materials can also be used.

R phosphor; (Y,Gd) $BO_3$:Eu

G phosphor; a mixture of (Y,Gd) $BO_3$:Tb and $Zn_2SiO_4$:Mn

B phosphor; $BaMg_2Al_{14}O_{24}$:Eu

Furthermore, an intention of the present invention is not to include a Ne gas as a component of the discharge gas; accordingly, it is not necessary to eliminate the Ne gas that remains as a residual in the discharge space during, for example, the manufacturing process of the panel. That is, if the partial pressure ratio is no more than 0.5[%] to the total pressure (for example, an impurity level), the Ne gas in the discharge gas is unlikely to cause any substantive problem, thus is considered to be in a permissible range.

Additionally, in the embodiment above, as an example of the panel unit of the PDP apparatus, two panels are placed opposing each other and forming a discharge space therebetween. The essential part of the present invention, however, is the composition of the discharge gas. Consequently, different variations can be adopted for a configuration of the panel unit. For example, the present invention can be applied to a display apparatus constituted from a group of a plurality of spherical cells as disclosed in SID '04-Session 18.4: "Flexible AC Plasma Displays Using Plasma—spheres" (SID—Symposium Digest of Technical Paper, May 2004, Volume 35, Issue 1, pp.815-817, Carol A. Wedding et al, University of Toledo, Ohio) or a display apparatus constituted from a group of a plurality of columnar members as disclosed in Japanese Laid-Open patent application publication No. 2000-315460.

Also, in the above, as the first gas component (principal gas component), a Xe gas is adopted in the first and third embodiments, and a Kr gas is adopted in the second embodiment. However, these components can be changed properly in accordance with the phosphor constituting the phosphor layer of the back panel. That is, the principal gas component can be specified based on a wavelength of excitation light of the phosphor.

In addition, in the first to third embodiments, the thickness of the phosphor is set to not more than 20 [μm] in order to reduce the firing voltage. However, the thickness can be greater than that, and in this case, it is still possible to obtain an effect which corresponds to a change in the composition of the discharge gas in comparison to the conventional PDP apparatus. Further, regarding a material constituting the dielectric layer, it is possible to adopt a material other than $SiO_2$ and a non-lead low-melting-point glass which are adopted in the first to third embodiments.

Also, in the embodiment above, each electrode constituting the display electrode pair is made of a metal material such as Ag and Al—Nd. However, alternatively, a layered structure of Cu—Cr—Cu and other metal materials can be used, and, naturally, a layered structure of a transparent electrode layer and a bus line can be adopted, as been adopted by the conventional PDP apparatus.

Additionally, in the first embodiment and the like, the total pressure of the discharge gas is set in a range of $6.66\times10^4$ [Pa] or less. However, for a purpose of reducing the firing voltage, it is more preferable that the upper limit of the total pressure be set to $5.00\times10^4$ [Pa].

INDUSTRIAL APPLICABILITY

The present invention can maintain a high and stable display quality irrespective of duration of driving while also keeping high discharge efficiency. Thus, it is possible to apply the present invention to a large high-definition television, a large display apparatus and the like.

The invention claimed is:

1. A plasma display panel comprising a hermetically sealed container containing discharge gas in an inner space therein, the hermetically sealed container including a protective layer and a phosphor layer opposing each other across the space, wherein the discharge gas contains:

a first gas component composed of a rare gas element which emits light to excite a phosphor in the phosphor layer during a plasma discharge;

a second gas component composed of an argon gas; and a neon gas at a partial pressure ratio in a range of 0% to 0.5%, inclusive, to a total pressure of the discharge gas, and wherein the second gas component is contained at a partial pressure ratio in a range of 1% to 25%, inclusive, to the total pressure of the discharge gas, and the total pressure of the discharge gas in the space is from $1.50\times10^4$ Pa to $6.66\times10^4$ Pa, inclusive.

2. The plasma display panel of claim 1, wherein the first gas component is one of a xenon gas and a krypton gas.

3. The plasma display panel of claim 1, wherein the total pressure of the discharge gas is $5.00\times10^4$ Pa or less.

4. The plasma display panel of claim 1, wherein the second gas component is contained at a partial pressure ratio of 67% or less to the total pressure of the discharge gas.

5. The plasma display panel of claim 1, wherein
the first gas component accounts for a principal ratio of the discharge gas.

6. The plasma display panel of claim 5, wherein
the second gas component is contained at a partial pressure ratio of 15% or less to the total pressure of the discharge gas.

7. The plasma display panel of claim 1, wherein
the second gas component is contained at a partial pressure ratio of 3% or more to the total pressure of the discharge gas.

8. The plasma display panel of claim 1, wherein
the discharge gas contains a third gas component composed of an oxygen gas.

9. The plasma display panel of claim 8, wherein
the third gas component is contained at a partial pressure ratio in a range of 0.01% to 1%, inclusive, to the total pressure of the discharge gas.

10. The plasma display panel of claim 1, wherein
a dielectric layer is disposed on a surface of the protective layer, the surface facing away from the space in a thickness direction of the hermetically sealed container, the dielectric layer having a thickness of 20 μm or less.

11. The plasma display panel of claim 10, wherein
an electrode pair is disposed on a surface of the dielectric layer, the surface facing away from the space in a thickness direction of the hermetically sealed container, each electrode of the electrode pair being made of a metal material and not including an oxide film.

12. The plasma display panel of claim 1, wherein
the protective layer is made of magnesium oxide.

13. A plasma display panel apparatus comprising i) a panel unit having a hermetically sealed container containing discharge gas in an inner space therein, the hermetically sealed container including a protective layer and a phosphor layer opposing each other across the inner space and ii) a drive unit operable to apply, in accordance with an inputted image signal, a voltage pulse to each electrode of an electrode pair of the panel unit, wherein the discharge gas contains:
a first gas component composed of a rare gas element which emits light to excite a phosphor in the phosphor layer during a plasma discharge;
a second gas component composed of an argon gas; and
a neon gas at a partial pressure ratio in a range of 0% to 0.5%, inclusive, to a total pressure of the discharge gas, and
the second gas component is contained at a partial pressure ratio in a range of 1% to 25%, inclusive, to the total pressure of the discharge gas, and
the total pressure of the discharge gas in the space is from $1.50\times10^4$ Pa to $6.66\times10^4$ Pa, inclusive.

14. The plasma display panel apparatus of claim 13, wherein
the first gas component is one of a xenon gas and a krypton gas.

15. The plasma display panel apparatus of claim 13, wherein
the total pressure of the discharge gas is $5.00\times10^4$ Pa or less.

16. The plasma display panel apparatus of claim 13, wherein
the second gas component is contained at a partial pressure ratio of 67% or less to the total pressure of the discharge gas.

17. The plasma display panel apparatus of claim 13, wherein
the first gas component accounts for a principal ratio of the discharge gas.

18. The plasma display panel apparatus of claim 17, wherein
the second gas component is contained at a partial pressure ratio of 15% or less to the total pressure of the discharge gas.

19. The plasma display panel apparatus of claim 13, wherein
the second gas component is contained at a partial pressure ratio of 3% or more to the total pressure of the discharge gas.

20. The plasma display panel apparatus of claim 13, wherein
the discharge gas contains a third gas component composed of an oxygen gas.

21. The plasma display panel apparatus of claim 20, wherein
the third gas component of the discharge gas is contained at a partial pressure ratio in a range of 0.01% to 1%, inclusive, to the total pressure of the discharge gas.

22. The plasma display panel apparatus of claim 13, wherein
a dielectric layer is disposed on a surface of the protective layer, the surface facing away from the space in a thickness direction of the hermetically sealed container, the dielectric layer having a thickness of 20 μm or less.

23. The plasma display panel apparatus of claim 22, wherein
an electrode pair is disposed on a surface of the dielectric layer, the surface facing away from the space in a thickness direction of the hermetically sealed container, each electrode of the electrode pair being made of a metal material and not including an oxide film.

24. The plasma display panel apparatus of claim 13, wherein
the protective layer is made of magnesium oxide.

* * * * *